US009895745B2

(12) United States Patent
Diel et al.

(10) Patent No.: US 9,895,745 B2
(45) Date of Patent: Feb. 20, 2018

(54) METHOD FOR DEMOULDING A CASTING, CAST FROM A LIGHT METAL MELT, FROM A CASTING MOULD

(71) Applicant: Nemak, S.A.B. de C.V., Garcia (MX)

(72) Inventors: Valentin Diel, Heusweiler (DE); Heiko Weber, Schmelz (DE); Detlef Kube, Rehlingen-Siersburg (DE); Marcus Speicher, Saarbrucken (DE)

(73) Assignee: Nemak, S.A.B. de C.V., Nuevo Leon (MX)

( * ) Notice: Subject to any disclaimer, the term of this patent is extended or adjusted under 35 U.S.C. 154(b) by 0 days.

(21) Appl. No.: 14/916,374

(22) PCT Filed: Sep. 4, 2013

(86) PCT No.: PCT/EP2013/068277
§ 371 (c)(1),
(2) Date: Mar. 3, 2016

(87) PCT Pub. No.: WO2015/032427
PCT Pub. Date: Mar. 12, 2015

(65) Prior Publication Data

US 2016/0193655 A1 Jul. 7, 2016

(51) Int. Cl.
*B22D 29/00* (2006.01)
*B22D 27/04* (2006.01)
(Continued)

(52) U.S. Cl.
CPC ..... *B22D 29/003* (2013.01); *B22D 21/007* (2013.01); *B22D 25/02* (2013.01);
(Continued)

(58) Field of Classification Search
CPC .. B22D 29/001; B22D 29/003; B22D 21/007; B22D 25/02; B22D 27/04
(Continued)

(56) References Cited

U.S. PATENT DOCUMENTS 4,047,882 A * 9/1977 Morita ..... B22C 9/12 164/12
2005/0178521 A1* 8/2005 Grassi et al. ..... B22C 9/046 164/34

FOREIGN PATENT DOCUMENTS

DE 69318000 T3 7/2005
JP 62259661 A 11/1987
(Continued)

*Primary Examiner* — Kevin P Kerns
(74) *Attorney, Agent, or Firm* — The Webb Law Firm

(57) ABSTRACT

A method for demolding a casting from a casting mold having at least one casting core which images a passage opening in the casting connecting two outer sides of the casting and is produced from a molding material bound by a binder which decomposes under the influence of temperature, wherein the casting mold undergoes a heat treatment in a furnace for the demolding, during which it is heated to a temperature at which the binder loses its binding effect. In the furnace, hot gas is flowed through a passage formed in the casting core of the casting mold, the temperature of the hot gas corresponding at least to the temperature at which the binder of the molding material loses it binding effect such that the casting core decomposes into fragments or separate sand particles as a consequence of the influence of the hot gas.

10 Claims, 4 Drawing Sheets

(51) Int. Cl.

| | |
|---|---|
| ***B22D 21/00*** | (2006.01) |
| ***B22D 25/02*** | (2006.01) |
| ***C21D 1/26*** | (2006.01) |
| ***C21D 9/00*** | (2006.01) |
| ***C22F 1/04*** | (2006.01) |

(52) U.S. Cl.
CPC ..... *B22D 27/04* (2013.01); *C21D 1/26* (2013.01); *C21D 9/0068* (2013.01); *C22F 1/04* (2013.01)

(58) Field of Classification Search
USPC ..... 164/132
See application file for complete search history.

(56) References Cited

FOREIGN PATENT DOCUMENTS

| | | | | | |
|---|---|---|---|---|---|
| JP | 8224656 | A | | 9/1996 | |
| JP | 2006-231360 | A | * | 9/2006 | ..... B22D 29/00 |
| KR | 1020020026552 | A | | 4/2002 | |
| WO | 9404297 | A1 | | 3/1994 | |
| WO | 2004014581 | A2 | | 2/2004 | |

* cited by examiner

METHOD FOR DEMOULDING A CASTING, CAST FROM A LIGHT METAL MELT, FROM A CASTING MOULD

CROSS-REFERENCE TO RELATED APPLICATION

This application is the United States national phase of International Application No. PCT/EP2013/068277 filed Sep. 4, 2013, the disclosure of which is hereby incorporated in its entirety by reference.

BACKGROUND OF THE INVENTION

Field of the Invention

The invention relates to a method for demoulding a casting, cast from a light metal melt, from a casting mould. The casting mould thereby comprises at least one casting core which images a passage opening in the casting connecting two outer sides of the casting and is produced from a moulding material which is bound by means of a binder which decomposes under the influence of temperature. The casting mould undergoes a heat treatment in a furnace for the demoulding, during which it is heated to a temperature at which the binder of the casting core loses its binding effect.

Description of Related Art

Such methods, also known among experts as "thermal desanding", are used in practice in particular during the casting of engine blocks or cylinder heads for combustion engines from light metal on a large scale. Because of their usually complex filigree design, castings of this type are frequently cast in casting moulds which are assembled as a so-called "core package" made from a plurality of single cores which are respectively prefabricated from moulding material. Casting cores produced from moulding material are, however, also used in gravity die casting in order to mould channels and passage openings provided in the inner region of the respective casting.

The moulding materials from which the casting cores of the type discussed here are formed usually consist of a mixture of a suitable moulding sand and the binder which binds the separate particles of the moulding sand to one another in the completed casting core and in this way ensures the required shape stability of the core formed from the moulding material. Additionally, the moulding material can contain certain additives which improve the interaction of the binder and the moulding sand or the behaviour of the respective casting core during the casting of the melt.

The binder can be an inorganic binder which is solidifiable by supplying heat or an organic binder which is solidifiable by gassing it with a reaction gas. These binders have in common that they lose their effect if a certain upper limit temperature is exceeded and the binder at least partially combusts. As soon as this point is reached, the casting cores produced using such binders decompose into fragments or separate sand particles which fall away from the casting. The goal therein is to control the decomposition of the casting cores such that as low quantities of moulding material as possible remain in or on the casting.

In practice, the temperature at which the heat treatment implemented for thermal desanding takes place is set so high that the binder combusts in the furnace almost completely. The remaining moulding sand can then be prepared for reuse with little effort.

The thermal desanding can be used particularly effectively if, as for example is known from DE 693 18 000 T3 (EP 0 612 276 B1), the desanding of the casting and the processing of the moulding sand are coupled with a solution annealing treatment of the casting and these three work steps are performed in a continuous run in a furnace. In order to improve the result of the processing of the moulding sand, the fragments of the casting cores falling away from the castings are collected in a moulding sand bed in the furnace, which is fluidised by blowing in a fluid gas flow such that the fragments of the moulding sand are constantly moving and decompose quickly into their separate sand particles as a consequence of their thus enforced abrasive exposure.

The coupling of thermal desanding, processing of the moulding sand and solution annealing treatment of the casting causes a comparably long duration of stay of the castings in the respective furnace. If, for an operation-specific large-scale implementation of methods of the type discussed here, the casting moulds and castings are to be heat-treated in a continuous run, this leads to continuous furnaces of considerable length. It is also shown that the thermal desanding of casting cores which image passage openings in the casting is achieved only in an imperfectly reliable manner even if these passage openings are cylinder openings or similar which have a large diameter.

With this background of the prior art explained above, the object is to improve the effectiveness and the desanding result of a method of the type specified at the beginning.

SUMMARY OF THE INVENTION

As in the case of thermal desanding of the type explained above, according to the invention, during demoulding of a casting, cast from a light metal melt, from a casting mould which comprises at least one casting core which images a passage opening in the casting connecting two outer sides of the casting and is produced from a moulding material which is bound by means of a binder which decomposes under the influence of temperature, the casting mould undergoes a heat treatment in a furnace for the demoulding, during which it is heated to a temperature at which the binder of the casting core loses its binding effect.

According to the invention, a passage which is formed in the casting core of the casting mould imaging the passage opening is flowed through by hot gas, the temperature of which corresponds at least to the temperature at which the binder of the moulding material loses its binding effect such that the casting core imaging the passage opening decomposes into fragments or separate sand particles as a consequence of the influence of the hot gas. The passage of the casting mould is thereby laid out in the casting core imaging the passage opening such that it leads from a first outer side to another outer side of the casting mould.

When "loss of binding effect" is referred to here, it is respectively meant thereby that the binder is at least in some places no longer able to hold together the moulding material of the casting core as a consequence of an at least partial combustion or of another type of chemical decomposition.

The passage of the casting mould provided according to the invention can already be present during entry into the furnace. To prevent the binder becoming ineffective too early, the passage opening can thereby firstly be closed by a tool such as a thin cover made from combustible material, for example cardboard, sand, combustible non-woven fabric or similar. In this way, the risk is counteracted that a flowing through of the passage with air from the environment and an accompanying premature combustion of the binder of the casting core imaging the passage opening of the casting occurs in the region of the passage before the entry into the furnace due to the stack effect. The cover combusts after a very short time in the furnace with the result that the effect used according to the invention, in particular the flowing through of the passage with hot gas, occurs in the furnace.

Alternatively, it is also possible to only form the passage in the furnace, for example by the casting mould being formed such that the passage is released if a first mould part falls away from the casting mould as a consequence of the decomposition of the binder, or by the passage being introduced into the casting mould in the entry region of the furnace using the influence of mechanical force.

According to the invention, therefore a casting mould is used which is formed such that the intensity with which it is exposed to the hot atmosphere prevailing during the heat treatment is clearly increased compared to the conventional procedure. For this purpose, at least one passage is provided on the casting mould, via which the hot gas formed from the furnace atmosphere also reaches the inside of the casting cores of the casting mould lying in the castings. In this way, the casting cores arranged inside of the casting are also heated quickly to a temperature at which their binder loses its force. This firstly applies to the casting core which is provided with the passage through which the hot gas flows, however it also applies, if present, to the casting cores abutting onto it which image further channels, cavities and similar in the casting.

In the case of usual heat treatment furnaces for casting moulds and castings of the type discussed here, the furnace atmosphere contains oxygen with the result that the hot gas passing through the passage of the casting mould provided according to the invention can also contain oxygen. The particular advantage of the flowing through of the casting mould with hot gas provided according to the invention is that with the hot gas larger quantities of oxygen even reach the inner regions of the casting mould in a targeted manner, whereby the combustion of the moulding material binder is promoted and correspondingly the decomposition even of the inner-lying casting cores is accelerated and completed.

Besides the accelerated decomposition of the binder of the casting cores, the accelerated heating caused by the direct flowing through according to the invention of inner-lying casting cores of the casting mould with hot gas leads to increased thermal stresses in the casting cores which likewise contribute to an increased effectiveness and to an optimised result of the thermal desanding caused according to the invention.

In principle, it is conceivable to enforce the hot gas flow flowing through the passage provided in the casting mould according to the invention using a fan or similar. Practical tests have, however, shown that also natural convection is sufficient in order to achieve the effects which are utilised according to the invention. Thus, a stack effect occurs due to which a natural hot gas flow through the passage is formed, in almost any alignment of the passage. To that end, it is proven to be particularly advantageous if the passage of the casting core of the casting mould through which the hot gas flows is aligned vertically in the furnace. This can be implemented particularly easily if the light metal castings are engine blocks for combustion engines, at least one cylinder opening and the adjacent crank case of which is respectively formed by at least one casting core provided with a passage for the hot gas in a manner according to the invention.

It goes without saying here that it is crucial that the passage provided according to the invention is guided completely though the casting mould independently of how many casting cores mould the respective passage opening. Correspondingly, in the case of a casting mould provided for the implementation of the method according to the invention, the passage opening of the casting can be imaged by two or more casting cores which respectively have a passage, wherein the passages of the casting cores are connected to each other and hot gas in the furnace flows therethrough. An example of such an embodiment is the casting mould already referred to above for an engine block for a combustion engine in the case of which the respective cylinder opening is moulded by one or more casting cores which sit on a further casting core which moulds the crank case of the engine block. According to the invention, all of these casting cores are provided with a passage, wherein these passages are aligned in alignment in an optimal manner such that an intensive, unhindered flowing through with hot gas is possible.

The invention has proven to be particularly advantageous for such casting moulds which are formed as a core package which is assembled from two or more casting cores. Obviously, such a core package can thereby not only comprise casting cores, but in an intrinsically known manner also cooling elements made from metal or chromite sand, such as chill castings for the bearing channel, the cylinder bore or other highly-stressed regions of the combustion engine. Chill moulds, chill casting plates, which can replace complete cores and all comparable functional parts are also included in this. Likewise, cylinder-shaped so-called "liners" can sit in the core package, which are cast from a material which is more resilient than the casting material from which the engine is cast and which limit the cylinder chambers in the completed combustion engine in which the pistons of the engine move during use.

The quick and intense heating-through caused by the design of the casting mould according to the invention leads, especially in the case of core package casting moulds, to high thermal stresses and an intensive combustion of the binder, whereby the complete decomposition of the inner- and outer-lying casting cores is promoted. Therefore, it could be shown that in the case of a thermal desanding of engine blocks occurring according to the invention, the sand of the casting cores provided with the passage which guides hot gas, said casting cores imaging the crank case and the cylinder openings of the engine block, was removed to be as free of residue as possible and the outer-lying casting cores could be removed to a clearly greater extent than is possible in conventional procedures.

The effectiveness of the desanding of the outer-lying casting cores of a casting mould core package can be further improved by indentations being moulded into the casting cores of the core package forming the outer side parts of the casting mould. Due to these indentations, not only is moulding sand and consequently weight of the casting mould saved in an intrinsically known manner, but also the contact surface for the hot gas is enlarged. In this way, large quantities of oxygen reach deep into the casting core forming the respective side part with the result that the binder thereof combusts almost completely in a shorter time.

As long as the casting mould is a core package, as a rule planar side parts normally cover the casting mould on its base, sides and on its cover side. Especially, in the case of a casting mould designed in such a way, it has proven to be particularly advantageous if the at least one casting core imaging the passage opening of the casting strikes the respective side part forming the outer border of the casting mould and the passage of the casting core imaging the passage opening is continued in the outer side part until the outer surface of the casting mould. The hot gas then also flowing through the passage of the respective side part causes the regions of the side part abutting onto the passage to be heated quickly with the consequence that the binder present there combusts in an accelerated manner and stresses occur which accelerate the decomposition of the side part.

The procedure according to the invention has then proven to be particularly effective if the heat treatment which the casting mould undergoes in the furnace is implemented as a solution annealing treatment of the casting. The flowing through of an inner-lying passage with hot gas according to the invention causes not only a quick heating of the casting core respectively provided with the passage for the hot gas, but preferably also an accelerated and at the same time uniform heating of the casting volume, since henceforth the heat in the furnace no longer has to penetrate exclusively from the outer side to inside of the casting, but heat is also conducted directly into an inner-lying region.

The same way as the intrinsically known coupling with solution annealing, the intrinsically known processing of the moulding material can be implemented in combination with a thermal desanding according to the invention, during which the fragments forming due to the decomposition of the binder and falling away from the casting are collected and held in the furnace. The decomposition of the fragments into separate moulding sand particles can thereby be supported in a likewise known manner by the collected fragments being kept moving in the furnace by blowing a gas flow into the moulding material bed which is formed from the fragments in the furnace.

As a result, it is therefore achieved with the invention, in a simple manner, to thermally demould casting pieces more quickly and efficiently than is possible in the case of conventional procedures. As a consequence of the quicker decomposition and the quick heating to the respective heat treatment temperature, the detention or processing time, for which the respective casting mould stays in the heat treatment furnace during the heat treatment required for the desanding can be clearly reduced. This then applies in particular if the desanding according to the invention is combined with a solution annealing treatment of the casting part. Therefore, it could be proven that in the case of the procedure according to the invention, the solution annealing time, i.e. the time for which the casting had to be held at the solution annealing temperature, can be clearly shortened. Practical tests have yielded here that, in the procedure according to the invention, the run times which are necessary for the desanding and solution annealing occurring in one run of engine blocks for combustion engines cast from an aluminium melt can be up to 60 minutes shorter than in the case of conventional operation. The practical investigations anticipate that even greater reductions are also possible.

After the thermal desanding implemented according to the invention, clearly less residual sand remains on the casting piece than in the case of conventional procedures, as not only is a better core removal engaged in the region of the respective passage opening, but as a consequence of the quicker heating of the casting part, other inner-lying cores of the casting mould are likewise heated more quickly with the result that in the case of the inner-lying cores, an intensive decomposition of the binder is used and, accompanying this, the relevant cores decompose into small fragments and sand particles which can easily trickle out of the casting. In this way, desanded castings according to the invention fulfil the highest quality requirements without expensive measures for the removal of the residual dirt and sand from the channels to be imaged on the casting having to be taken.

Due to the quick decomposition of the casting cores caused according to the invention and the quick heating of the casting, the heat treatment times required for thermal core removal and for the solution annealing treatment combined if necessary therewith can be reduced. This again allows the furnaces necessary for an implementation of the method occurring in one run to be constructed to be shorter and therefore in a less expensive manner and to be operated with lower energy expenditure. Additionally, moulding material and weight is saved by the passage provided according to the invention which additionally contributes to the cost reduction achieved by the procedure according to the invention.

DESCRIPTION OF THE INVENTION

Figure 1:
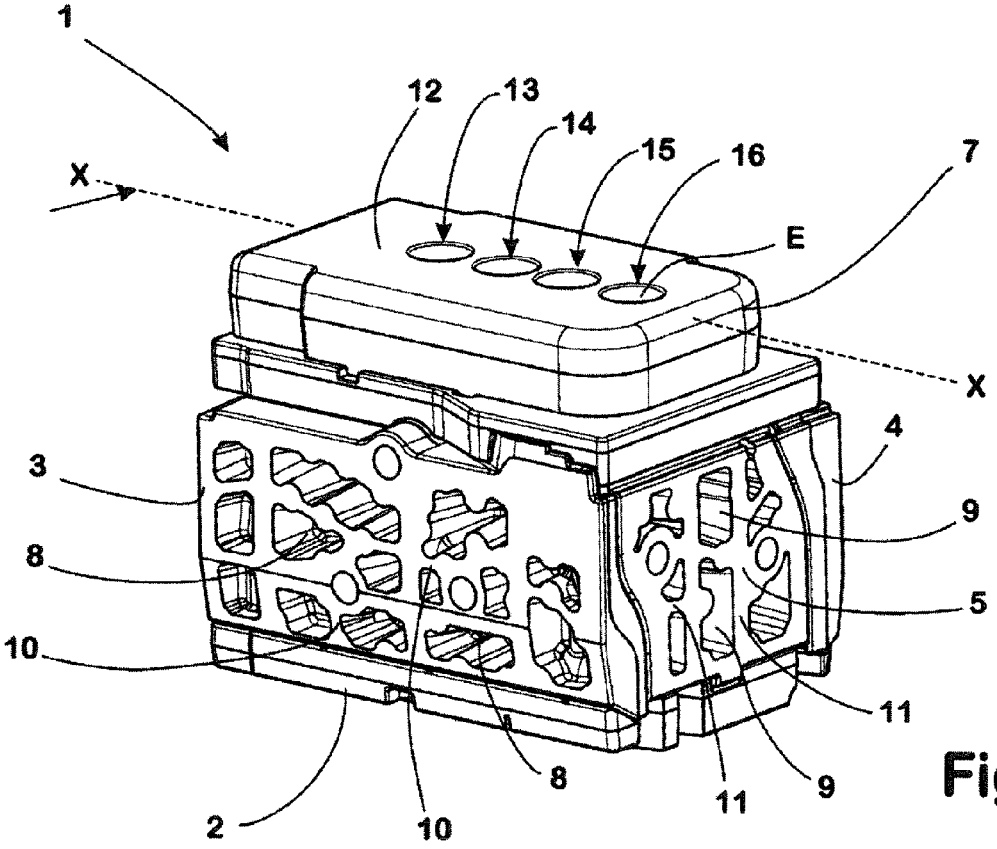
FIG. 1 is a casting mould in a perspective view.

The rectangular casting mould 1 serves for the casting of an engine block M for a combustion engine which is not shown further here.

The casting mould 1 is assembled as a core package made from a plurality of casting cores. The casting cores are respectively produced in an intrinsically known manner from a moulding material which has been moulded into the casting cores as a mixture of a moulding sand and an organic binder as well as, if necessary, optionally added additives in a core shooter not depicted here, said casting cores having been subsequently solidified by gassing with a reaction gas.

The cores can alternatively be produced with all organic core production methods known in prior art, such as, for example warm box, hot box, croning, hand moulding methods and self-hardening methods without catalysts.

Included in the casting cores of the casting mould 1 are a casting core 2 which forms the base of the casting mould 1 and on which the other casting cores of the casting mould 1 are constructed, two casting cores 3, 4 of which one is respectively allocated to one of the longitudinal sides of the casting mould 1 and which delimit the casting mould 1 on its longitudinal sides, two casting cores 5, 6 of which one is respectively allocated to one of the front sides of the casting mould 1 and which delimit the casting mould 1 on its front sides, as well as a cover core 7 which completes the casting mould 1 on its upper side.

Respectively, several indentations 8, 9 are moulded into the casting cores 3, 4 forming the lateral border of the casting mould 1 on the longitudinal sides thereof and the casting cores 5, 6 forming the lateral border of the casting mould 1 on the front sides thereof. The indentations 8, 9 are thereby arranged such that, and recessed into the respective casting core 3-6 over such a depth that, on the one hand a wall thickness remains in the region of their base which is sufficient in order to securely enclose the casting chamber surrounded by the casting mould 1, but on the other hand respectively only bars 10, 11 remain between the indentations 8, 9 with a thickness which ensures a strength which is sufficient for the inherent rigidity of the respective casting core 3-6, however at the same time enables a simple breakup of the bars 8, 9 and in an accompanying manner of the respective casting core 3-6 if the binder of the moulding material from which the casting cores 3-6 are formed is ineffective.

Four passage openings 13-16 aligned perpendicularly to the flat outer cover surface 12 of the cover core 7 and arranged at equal distances are moulded into the cover core 7, said passage openings 13-16 leading from the cover surface 12 into the space surrounded by the casting cores 2-7.

Figure 2:
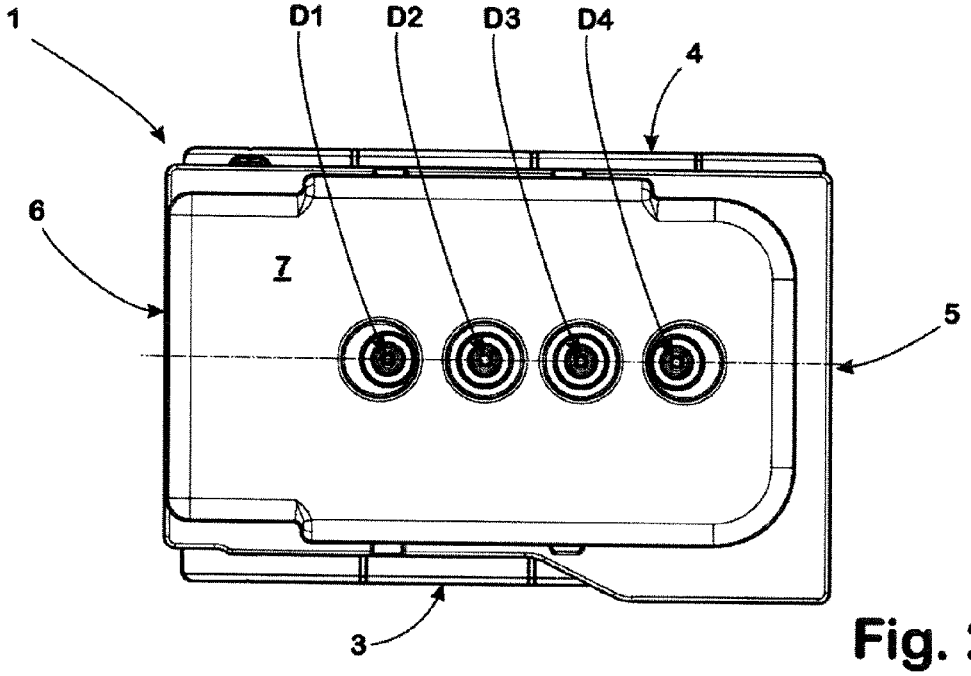
FIG. 2 is the casting mould according to FIG. 1 in a view from above.
Figure 3:
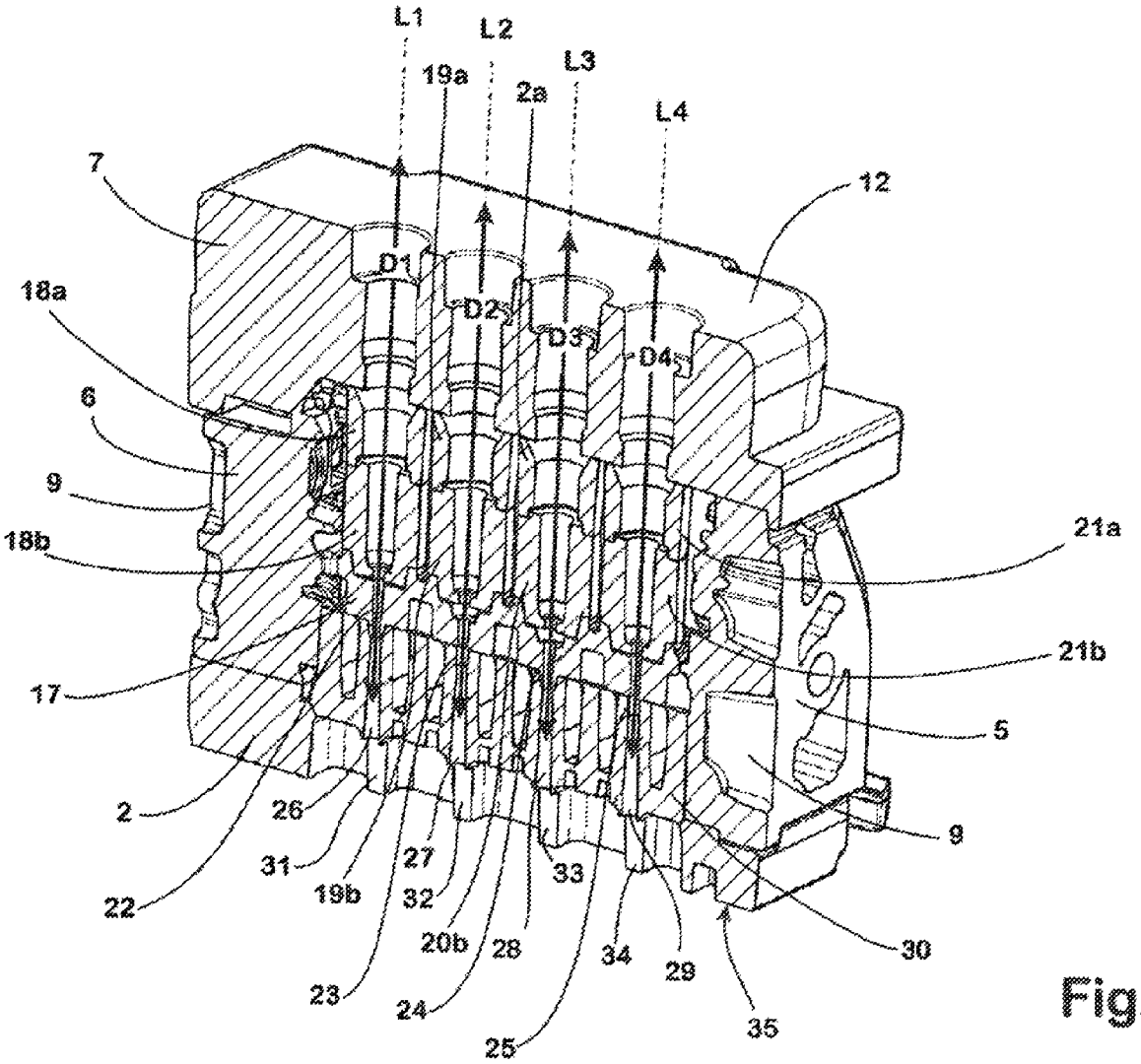
FIG. 3 is the casting mould according to FIG. 1 in a cut along the intersection X-X recorded in FIG. 1.

A circumferential recess is moulded into the edge region of the passage openings 6 abutting onto the cover surface 12. A cover E which is produced from the moulding material from which the cover core 7 itself is also formed, from cardboard or combustible felt, and is approximately 1 cm thick and which is laid loosely in the opening 13-16 sits respectively on this recess in order to hold the passage openings 13-16 closed after the decantation of the engine block casting M until the heat treatment which is implemented to desand and solution anneal begins. Alternatively to a separate cover E, the passage openings 13-16 can also be closed with a membrane-like cover layer which is connected in one piece to the surrounding core material of the cover core 7 and which, if it is exposed to the temperature existing during the heat treatment, decomposes quickly and releases the respective passage opening 13-16. In FIGS. 2 and 3, the covers E are left off such that the free passages D1-D4 through the casting mould 1 formed in the manner described below and provided according to the invention are visible.

Figure 4:
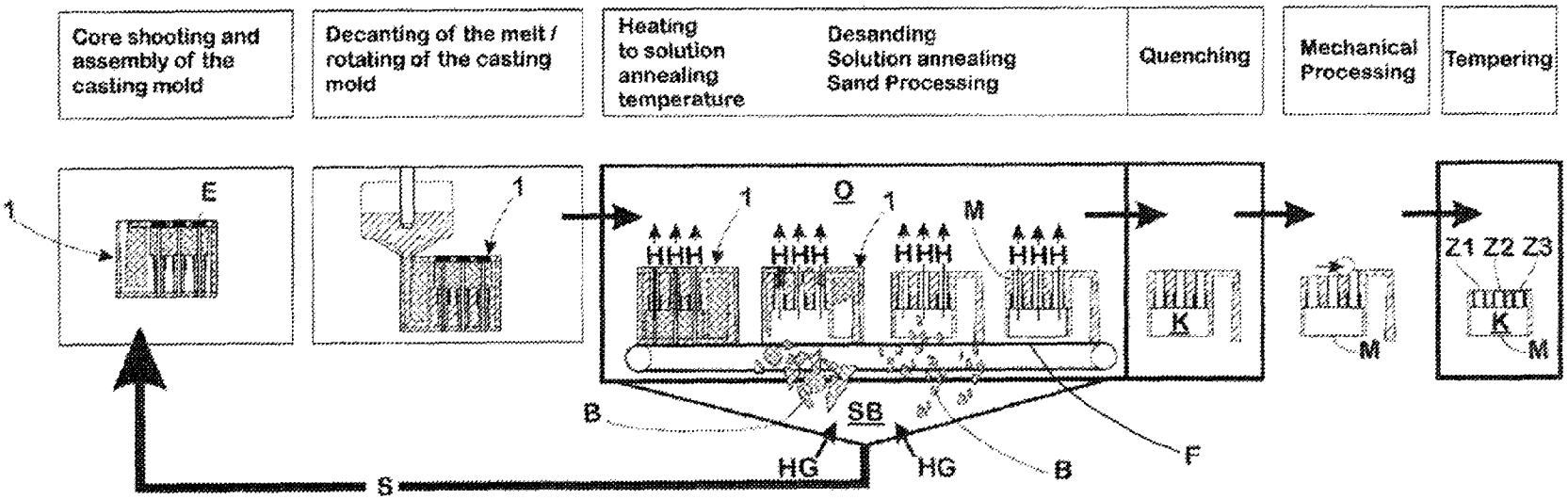
FIG. 4 is the sequence of the work steps completed in the production of a casting involving the method according to the invention.

In the space surrounded by the casting cores 2-7, four pairs of two annular casting cores 18*a*, 18*b*, 19*a*, 19*b*, 20*a*, 20*b* and 21*a*, 21*b* respectively which are stacked one on top of the other sit on a central casting core 17 which images the upper part of the crank case K of the engine block casting M in a seat provided for this respectively. The casting core pairs 18*a*, 18*b*, 19*a*, 19*b*, 20*a*, 20*b* and 21*a*, 21*b* respectively border with their outer peripheral surfaces one of the four cylinder chambers of the engine block casting M, of which, for the sake of clarity, in FIG. 4 only three cylinder chambers Z1-Z3 are depicted symbolically. The cylinder chambers respectively form a passage opening of the engine block casting M. The annular openings surrounded by the casting cores 18*a*-21*b* are, at the same time, aligned in alignment with one other and with regard to the respectively allocated passage openings 13-16 of the cover core 7 sitting flush on the edge of the respective upper casting core 18*b*, 19*b*, 20*b*, 21*b* allocated to it, such that they form the continuation of the passage openings 13-16.

In an extension of the annular space of the respective lower casting core 18*a*, 19*a*, 20*a*, 21*a* of the casting cores 18*a*-21*b*, a further passage opening 22-25 is moulded into the planar casting core 17, which is likewise arranged in alignment with the allocated passage opening 13-16 of the cover core 7.

The passage openings 22-25 respectively merge into a passage opening 26-29 at their lower end allocated to the base core 2. The passage openings 26-29 are moulded in a funnel shape in the direction of the base core 2 in an extending manner into a further casting core 30 which moulds the lower part of the crank case K and sits on the base core 2.

Finally, four further passage openings 31-34 are moulded into the base core 2, of which one respectively is allocated to the passage openings 26-29.

The passage openings 13, 22, 26 and 31 which are aligned in alignment with each other and coaxially to a mutual longitudinal axis L1 form, together with the annular openings enclosed by the casting cores 18*a*, 18*b*, a first passage D1 which leads from the flat contact surface 35, with which the base core 2 stands on the respective ground during use, to the likewise flat cover surface 12 of the cover core 7.

In a corresponding manner, the passage openings 14, 23, 27 and 32 which are aligned in alignment with each other and coaxially to a mutual longitudinal axis L2 arranged axially parallel to the longitudinal axis L1 form, together with the annular openings enclosed by the casting cores 19*a*, 19*b*, a second passage D2, the passage openings 15, 24, 28 and 33 aligned in alignment with each other and coaxially to a mutual longitudinal axis L3 arranged axially parallel to the longitudinal axis L1 form, together with the annular openings enclosed by the casting cores 20*a*, 20*b*, a third passage D3 and the passage openings 16, 25, 29 and 34 aligned in alignment with each other and coaxially to a mutual longitudinal axis L4 arranged likewise axially parallel to the longitudinal axis L1 form, together with the annular openings enclosed by the casting cores 21*a*, 21*b*, a fourth passage D4.

To produce an engine block M, the casting mould 1 is assembled in a first processing station from the casting cores 2-7, 17, 18*a*-21*b* and 30 as well as further casting cores which are not shown here for the sake of clarity.

Subsequently, the casting mould 1 is filled with aluminium melt. The casting mould 1 is thereby aligned around a horizontally aligned rotational axis such that it is arranged above and the cover core 2 is arranged below in the direction of the force of gravity. In this way, a filling opening which is not visible in FIGS. 1-3 of a feeder which is likewise not depicted in FIGS. 1-3, via which the filling of the casting mould 1 occurs, is arranged above for filling, whilst the feeder is located below in the direction of the force of gravity. After completion of the filling procedure, the casting mould 1 is pivoted again around the horizontally aligned pivot axis such that now the feeder and the cover core 7 lie above, whilst the filling opening of the feeder is arranged below in the direction of the force of gravity. Using this method, also referred to as "rotational moulding", an even solidification of the casting in the casting mould 1 is achieved.

At the earliest at the beginning of the solidification and at the latest after complete solidification of the aluminium melt in the casting mould 1, the casting mould 1 passes into a continuous furnace O in which the engine block M is desanded, the engine block M passes through a solution annealing treatment and the moulding material of the casting cores of the casting mould 1 falling away from the engine block M is prepared for reuse.

The casting mould 1 passing into the furnace O is heated for this purpose to the solution annealing temperature which typically lies in the range from 450-550° C. depending on the respectively processed Al casting alloy. This solution annealing temperature is higher than the temperature from which the binder of the moulding material of the casting cores of the casting mould 1 combusts.

As a consequence of natural convection, hot gas flows H thereby begin which flow from below through the passages D1-D4 of the casting mould 1. In this way, the decomposition of the casting mould 1 begins not only in the region of the outer casting cores 2-7, but also in the regions of the casting cores 17, 18*a*-21*b* and 30 covered by the hot gas flows H1-H4 inside the casting mould 1. At the same time, the light metal of the engine block M is also not only heated quickly to the solution annealing temperature from the outer side of the casting mould 1, but also from inside.

With progressive heating and consequently combustion of the binder of their moulding material, the binder becomes increasingly ineffective and the lateral casting cores 2-7 and the inner casting cores 2-7, 17, 18*a*-21*b* and 30 begin to decompose. The fragments and sand particles B falling away from the engine block casting M are collected in a sand bed SB provided under the conveyor path F of the casting mould 1 in the furnace O.

In order to keep the fragments B collected in the sand bed SB moving in order to promote their fragmentation and regeneration, hot gas HG is blown into the sand bed SB via nozzles embedded in the base of the furnace O. Due to the thus achieved fluidisation and tempering of the sand bed SB, the residual binder still contained in the casting core fragments B combusts and the fragments B are decomposed into their separate sand particles. The moulding sand S obtained by this processing is conducted back for reuse to the core shooter which produces the casting cores from which the respective casting mould 1 is assembled.

The further the engine block casting M is conveyed in the direction of the output of the furnace O, the more complete the desanding of the engine block M is, until finally even the smallest fragments B have trickled out from it.

When the output of the furnace O is reached, then the time necessary for the solution annealing treatment is also completed, such that the engine block casting M can be quenched to room temperature in a station which is subsequently directly passed through. After that, a mechanical processing occurs during which the feeders are separated and further machine processing operations take place on the engine block M. Subsequently, optionally a further relocation treatment then occurs.

Figure 5:
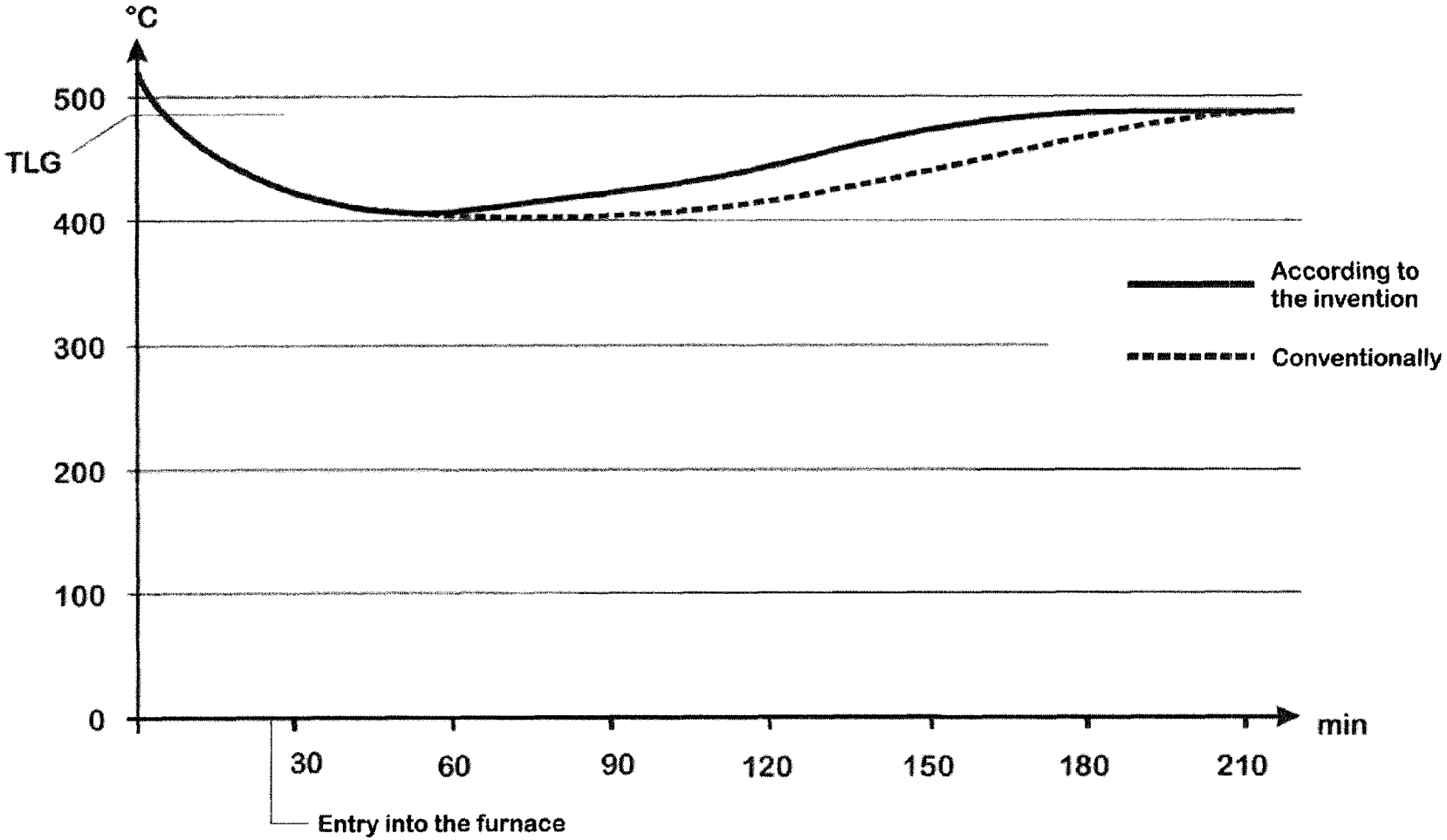
FIG. 5 is the temperature development in the engine block casting during the run through a continuous furnace until reaching the solution annealing temperature applied over time.

In FIG. 5, the temperature profile of the engine block casting M is depicted in the furnace O for an engine block casting which is desanded and solution annealed in a conventional operating method (dashed line) and a similar engine block casting part which is desanded and solution annealed in the manner according to the invention (solid line). The casting moulds containing the respective casting enter the furnace O after falling below the liquidus temperature of the aluminium melt from which the casting parts are cast, however when the respective engine block casting has still not completely solidified. In that the engine block castings are conducted into the furnace O in the only partially solidified state, the casting heat which is still inherent in this state can be used.

The temperature of the casting during conventional operation and that according to the invention during entry into the furnace O, amounted respectively to approx. 430° C. The casting which is flowed through by hot gas according to the invention, however, reached the solution annealing temperature TLG of approx. 485° C. clearly more quickly than the casting heated conventionally without through-flow. As a consequence, the casting flowed through with hot gas according to the invention stays at the solution annealing temperature TLG in the conventional furnace O approx. 90 minutes longer than the conventionally treated casting. As, at the same time, the desanding took place in a substantially more effective manner in the procedure according to the invention, the procedure according to the invention therefore enables the desanding and solution annealing process to be shortened by approx. 30% compared to the conventional procedure.

REFERENCE NUMERALS

1 Casting mould
2 Base casting core
3, 4 the casting cores bordering the longitudinal sides of the casting mould 1
5, 6 the casting cores bordering the front sides of the casting mould 1
7 Cover core
8, 9 Indentations
10, 11 Bars
12 Cover surface of the cover core 7
13-16 Passage openings of the cover core 7
17 Casting core
18*a*-21*b* Annular casting cores
22-25 Passage openings of the casting core 17
26-29 Passage openings of the casting core 30
30 Casting core
31-34 Passage openings of the base core 2
35 Contact surface of the base casting core 2
B Casting core fragments
D1-D4 Passages
E Cover
H Hot gas
HG Hot gas flows
K Crank case of the engine block M
M Engine block casting
O Continuous furnace
S Prepared moulding sand
SB Sand bed
Z1-Z3 Cylinder chambers of the engine block M
F Conveyor path

The invention claimed is:

1. A method for demoulding a casting, cast from a light metal melt, from a casting mould, the method comprising:

providing a casting mould, wherein internal passageways of the casting mould defining the casting have been filled with the light metal melt which has been at least partially solidified, the casting mould comprising a moulding material which is bound by means of a binder which decomposes under the influence of temperature, the casting mould including at least one casting core having an outer surface that mirrors an inner surface of a passage opening in the casting that connects two outer sides of the casting, and an inner passageway;

heating the casting mould in a furnace to a temperature at which the binder loses its binding effect; and flowing hot gas, the temperature of which corresponds at least to the temperature at which the binder of the moulding material loses its binding effect, through the inner passageway of the at least one core while the casting mould is heated in the furnace such that the at least one casting core decomposes into fragments or separate sand particles as a consequence of the influence of the hot gas.

2. The method according to claim 1, wherein the inner passageway of the at least one casting core of the casting mould is aligned vertically in the furnace.

3. The method according to claim 1, wherein the inner surface of the passage opening of the casting is mirrored by two or more casting cores which each have an inner passageway and the inner passageways of the casting cores are connected.

4. The method according to claim 1, wherein the casting mould is formed as a core package composed of two or more casting cores.

5. The method according to claim 4, wherein indentations are moulded into the casting cores which form outer side parts of the casting mould.

6. The method according to claim 1, wherein the at least one casting core abuts an outer side part which forms an outer surface of the casting mould, and the inner passageway of the casting connects with a passageway in the outer side part that extends to an outer surface of the casting mould.

7. The method according to claim 1, wherein the heating of the casting mould in the furnace is conducted at a temperature that solution anneals the casting.

8. The method according to claim 1, wherein the fragments of the at least one casting core, which are formed by the decomposition of the binder and which fall away from the casting, are collected and are held in the furnace until the binder still contained in the fragments is combusted.

9. The method according to claim 1, wherein the casting is an engine block for a combustion engine, and the passage opening is a cylinder opening.

10. The method according to claim 1, wherein the casting mould and the casting pass through the furnace in a continuous run.

* * * * *